US011608949B2

(12) United States Patent
Chen et al.

(10) Patent No.: US 11,608,949 B2
(45) Date of Patent: Mar. 21, 2023

(54) FIXTURE WITH ANGULARLY ADJUSTABLE LIGHT HOLDER AND RETRACTABLE MODIFIER SUPPORT

(71) Applicant: XIAMEN LEEDARSON LIGHTING CO., LTD, Fujian (CN)

(72) Inventors: Jinfu Chen, Fujian (CN); Zhenyu Tang, Fujian (CN); Shuxing Gao, Fujian (CN); Yongzhe Dong, Fujian (CN)

(73) Assignee: XIAMEN LEEDARSON LIGHTING CO., LTD, Fujian (CN)

( * ) Notice: Subject to any disclaimer, the term of this patent is extended or adjusted under 35 U.S.C. 154(b) by 51 days.

(21) Appl. No.: 17/334,253

(22) Filed: May 28, 2021

(65) Prior Publication Data

US 2021/0364140 A1 Nov. 25, 2021

(30) Foreign Application Priority Data

May 25, 2020 (CN) ..... 202020958068.1
May 29, 2020 (CN) ..... 202020957506.2
May 29, 2020 (CN) ..... 202020957705.3

(51) Int. Cl.

| | |
|---|---|
| ***F21V 21/30*** | (2006.01) |
| ***F21S 8/02*** | (2006.01) |
| ***F21V 19/02*** | (2006.01) |
| ***F21V 7/04*** | (2006.01) |
| ***F21V 5/04*** | (2006.01) |
| ***F21V 5/00*** | (2018.01) |
| ***F21V 23/06*** | (2006.01) |

(Continued)

(52) U.S. Cl.

CPC ..... *F21S 8/026* (2013.01); *F21V 5/008* (2013.01); *F21V 5/04* (2013.01); *F21V 7/04* (2013.01); *F21V 14/06* (2013.01); *F21V 19/02* (2013.01); *F21V 21/03* (2013.01); *F21V 23/007* (2013.01); *F21V 23/04* (2013.01); *F21V 23/06* (2013.01); *F21Y 2115/10* (2016.08)

(58) Field of Classification Search

CPC ..... F21V 21/30; F21V 19/02; F21V 14/02; F21V 14/06; F21V 14/08; F21S 8/02; F21S 8/026

See application file for complete search history.

(56) References Cited

U.S. PATENT DOCUMENTS 2,649,535 A * 8/1953 Feder ..... F21S 8/04 362/275
5,404,297 A * 4/1995 Birk ..... F21V 15/01 362/372

(Continued)

*Primary Examiner* — Ismael Negron
(74) *Attorney, Agent, or Firm* — Chun-Ming Shih; Lanway IPR Services

(57) ABSTRACT

An illumination apparatus includes a surface rim, a rotation ring, a light holder and a retractable tube. The surface rim has a rim cover, and a rim wall protruding from the rim cover and defining a light opening. The rotation ring is held by the rim wall to be rotatable along an axis of a center of the light opening. The light holder is used for support a light source. The light holder is fixed to the rotation ring by two rotation axles so that the light holder is capable of orienting a light source in a plurality of angles with respect to a plane of the rotation ring. The retractable tube has an optical cover, such that a distance between the optical cover and the light source is adjustable.

17 Claims, 10 Drawing Sheets

(51) Int. Cl.

| | |
|---|---|
| ***F21V 23/00*** | (2015.01) |
| ***F21V 23/04*** | (2006.01) |
| ***F21V 21/03*** | (2006.01) |
| ***F21V 14/06*** | (2006.01) |
| *F21Y 115/10* | (2016.01) |

(56) References Cited

U.S. PATENT DOCUMENTS

| | | | | |
|---|---|---|---|---|
| 6,350,043 | B1 * | 2/2002 | Gloisten | F21S 8/026 362/288 |
| 7,311,422 | B1 * | 12/2007 | Chen | F21V 21/30 362/427 |
| 9,194,561 | B2 * | 11/2015 | Wu | F21V 21/046 |
| 10,101,011 | B2 * | 10/2018 | Markey | F21V 19/02 |
| 10,215,374 | B2 * | 2/2019 | Xu | F21V 17/12 |
| 10,317,054 | B1 * | 6/2019 | Davis | F21S 8/026 |
| 11,015,794 | B2 * | 5/2021 | Portinga | F21V 17/02 |
| 2006/0250788 | A1 * | 11/2006 | Hodge | F21S 8/02 362/147 |
| 2010/0315812 | A1 * | 12/2010 | Liu | F21V 21/30 362/418 |
| 2013/0322084 | A1 * | 12/2013 | Ebisawa | F21V 21/04 362/427 |
| 2018/0180269 | A1 * | 6/2018 | Liu | F21V 21/02 |

* cited by examiner

FIXTURE WITH ANGULARLY ADJUSTABLE LIGHT HOLDER AND RETRACTABLE MODIFIER SUPPORT

FIELD

The present invention is related to a downlight apparatus, and more particularly related to a downlight apparatus with adjustment design.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

There are various types of lighting apparatuses. When cost and light efficiency of LED have shown great effect compared with traditional lighting devices, people look for even better light output. It is important to recognize factors that can bring more satisfaction and light quality and flexibility.

Downlight devices are widely used in various places. It is difficult to change the angle or light beam angle in traditional downlight devices.

It is therefore beneficial to find a way to provide a flexible way to adjust the downlight device with a compact design while meeting low cost factors.

SUMMARY

In some embodiments, a downlight apparatus includes a surface rim, a rotation ring, a light holder and a retractable tube.

The surface rim has a rim cover and an rim wall.

The rim wall protruding from the rim cover. The rim wall defines a light opening.

The rotation ring is held by the rim wall to be rotatable along an axis of a center of the light opening.

The light holder is used for support a light source.

The light holder is fixed to the rotation ring with two rotation axles so that the light holder is rotatable manually to change a tilt angle of the light holder with respect to the rotation ring.

The retractable tube has an optical cover.

The retractable tube is manually movable to change a distance between the optical cover and the light source.

In some embodiments, the rim wall provides a rotation track for holding the rotation ring to be rotated along the rotation track.

In some embodiments, the rotation track is formed by a track ring, the rim wall and multiple levers.

The track ring is an extension ring protruding inwardly from the rim wall to the light opening.

The track ring and the multiple levers limit movement of the rotation ring on two opposite edges of the rotation ring.

In some embodiments, the multiple levers are screws with a first portion kept in screw holes of the rim wall and a second portion protruding inwardly to the light opening to limit the movement of the rotation ring.

In some embodiments, the optical cover is a light passing cover.

A light beam angle of the light is adjusted by changing a distance between the optical cover and the light holder.

In some embodiments, the light holder has a reflective cup for guiding a light of the light source to a the optical cover.

In some embodiments, the optical cover includes a first lens for condensing a light of the light source to form a light beam.

In some embodiments, the light source has a second lens.

The light beam is determined by the first lens, the second lens and a relative distance between the first lens and the second lens.

In some embodiments, the downlight apparatus may also include an image mask for projecting a corresponding image with the light beam.

In some embodiments, a focus level of the projected image is adjusted by changing the relative distance between the first lens and the second lens.

In some embodiments, the rim wall has two connectors for attaching two torsion springs for fixing the downlight apparatus to a cavity of a ceiling.

In some embodiments, the light holder has a holder wall.

An inner side of the holder wall has a screw groove.

The retractable tube has an protruding bar on an exterior surface.

An offset distance between the light holder and the retractable tube is changed by moving the protruding bar of the retractable tube along the screw groove of the light holder.

In some embodiments, the light source is a LED module mounted on a central plate of the light holder.

In some embodiments, a back side of the central plate has a socket for routing electricity to the light source.

In some embodiments, the downlight apparatus may also include a driver for generating a driving current to the light source.

The light source has multiple types of LED modules.

The driver mixes lights of different optical parameters according to a rotation angle of the rotation ring with respect to the surface rim.

In some embodiments, the downlight apparatus may also include a manual switch.

The manual switch is operated to choose enabling or disabling adjustment of the optical parameter by rotating the rotation ring.

In some embodiments, the driver detects the distance between the optical cover and the light source to determines the driving current of the light source.

In some embodiments, the rotation ring is rotated with respect to the surface rim with a grid unit for selecting a rotation angle of the rotation ring with respect to the surface rim from multiple discrete candidate values.

In some embodiments, the light holder has an central tube.

The light source has a LED module mounted on a top plate of the central tube.

A driver is placed inside the central tube.

In some embodiments, the light holder has a back cover for concealing the driver in the central tube.

DETAILED DESCRIPTION

Figure 10:
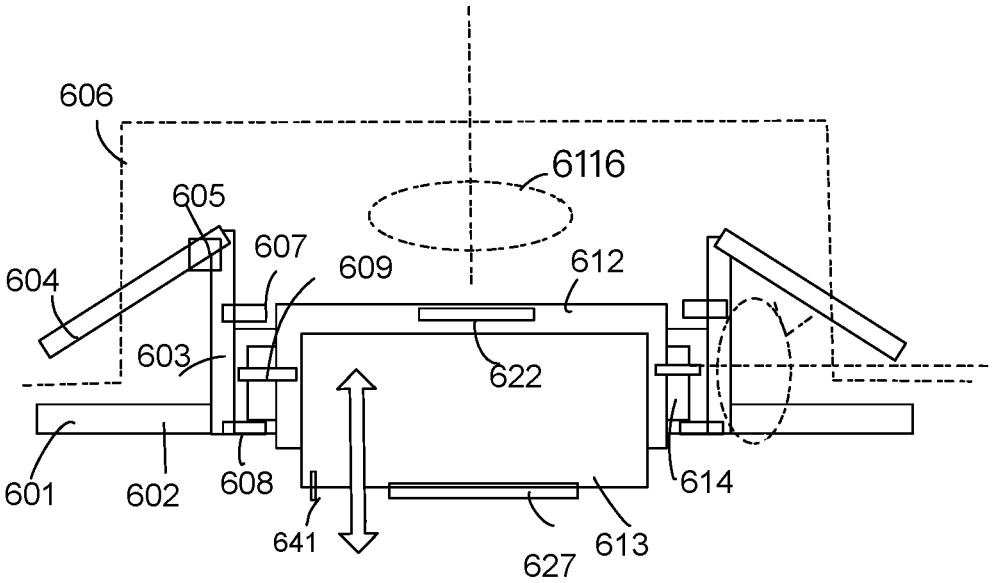
FIG. 10 illustrates another downlight embodiment.
Figure 11:
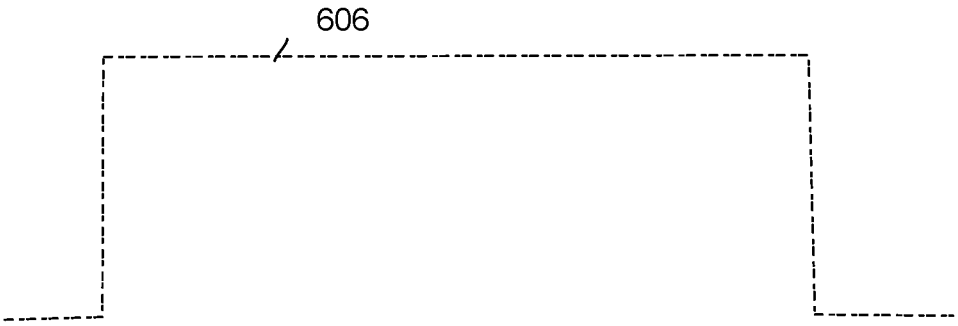
FIG. 11 illustrates an exploded view of the example in FIG. 10.
Figure 11:
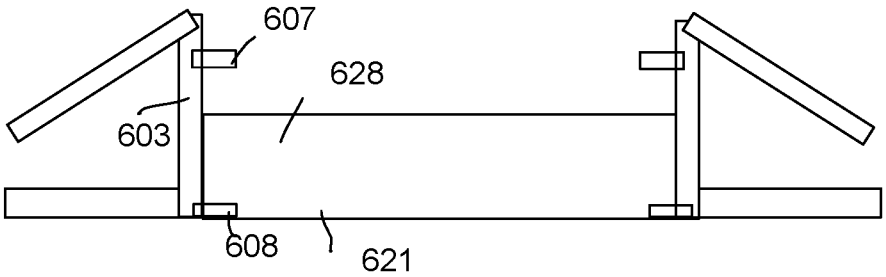
Figure 11:
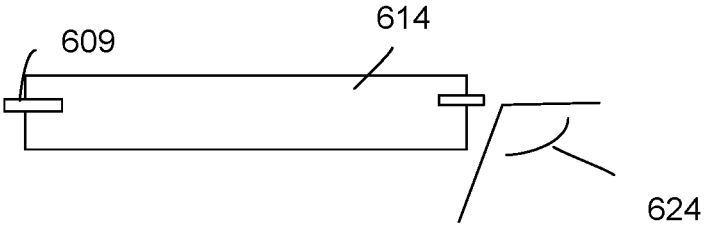
Figure 11:
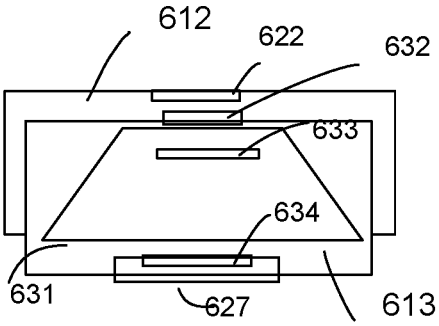

Please refer to FIG. 10 and FIG. 11. FIG. 10 shows a downlight embodiment. FIG. 11 shows an exploded view of the example in FIG. 10. The same reference numerals among drawings refer to the same components and would not be repeated again unless necessary for brevity.

In FIG. 10 and FIG. 11, a downlight apparatus includes a surface rim 601, a rotation ring 614, a light holder 612 and a retractable tube 613.

The surface rim 601 has a rim cover 602 and an rim wall 603.

The rim wall 603 protrudes from the rim cover 602. For example, the rim wall 603 form a protruding ring perpendicular to the rim cover 602. The rim wall 603 defines a light opening 621.

The rotation ring 614 is held by the rim wall 603 to be rotatable along an axis 610 of a center of the light opening 621. Specifically, the rotation ring 614 may be moved to rotate along the axis 610 along a circular track 6116.

The light holder 612 is used for support a light source 622.

The light holder 612 is fixed to the rotation ring 614 with two rotation axles 609 so that the light holder 612 is rotatable manually to change a tilt angle 624 of the light holder 612 with respect to the rotation ring 614.

With the rotation of the rotation ring 614 with respect to the surface rim 601, and the rotation of the light holder 612 with respect to the rotation ring 614, the light holder 612 is capable to be moved in two dimensions to manually adjust a required angle for the light source 622 to aim downwardly.

The retractable tube 613 has an optical cover 627. The optical cover 627 may include a lens, a diffusion cover and/or a simple transparent plastic cover for light to pass through.

The retractable tube 613 is manually movable to change a distance between the optical cover 627 and the light source 622. In addition to the movement of the rotation ring 614 with respect to the surface rim 601 and the movement of the light holder 612 with respect to the rotation ring 614, the retractable tube 613 may be further moved to adjust the usage of the downlight apparatus.

In some embodiments, the rim wall 603 provides a rotation track 628 for holding the rotation ring 614 to be rotated along the rotation track 628. In other words, the rotation track 628 is a confined space for keeping and rotating the rotation ring 614.

In some embodiments, the rotation track is formed by a track ring 608, the rim wall 603 and multiple levers 607.

The track ring 608 is an extension ring protruding inwardly from the rim wall 603 to the light opening 621. For example, the track ring 608 is a protruding area for holding the rotation ring 614 not to fall downwardly. The rim wall 603 prevents the rotation ring 614 to leave in lateral direction. The levers 607 prevent the rotation ring 614 to leave upwardly. In other words, the rotation ring 614 is kept in a rotatable space by the structure.

The multiple levers 607 may be an elastic protruding blocks or a block strips for the rotation ring 614 to attach to the surface rim 601 downwardly from top as illustrated in FIG. 10 and FIG. 11. The elastic protruding blocks may be deformed and recover to keep the rotation ring 614 to stay in the rotation space.

The track ring and the multiple levers limit movement of the rotation ring on two opposite edges of the rotation ring.

In some embodiments, the multiple levers are screws with a first portion kept in screw holes of the rim wall and a second portion protruding inwardly to the light opening to limit the movement of the rotation ring. For example, the rotation ring 614 is placed into the rotation space first. The screws are added to keep the rotation ring 614 to stay in the rotation space. A pin, a hook or other structure may be implemented as the levers mentioned here. A circular structure may also refer to multiple levers here for providing a limiting structure to keep the rotation ring 614 in the rotation space.

In some embodiments, the optical cover is a light passing cover.

A light beam angle of the light is adjusted by changing a distance between the optical cover and the light holder.

In some embodiments, the light holder has a reflective cup 631 for guiding a light of the light source to a the optical cover 627. For example, the light source 622 includes a light source plate mounted with a COB (chip on board) LED module. The light source 622 emits a light with a main light angle, e.g. 80% of light in a spreading angle of 120 degrees. By changing the relative distance between the optical cover 627 and the light source 622 changes the final output light range, thus changing the light beam spreading angle and width.

In some embodiments, the optical cover includes a first lens 634 for condensing a light of the light source to form a light beam.

In some embodiments, the light source has a second lens 632.

The light beam is determined by the first lens 634, the second lens 632 and a relative distance between the first lens 634 and the second lens 632.

In some embodiments, the downlight apparatus may also include an image mask 633 for projecting a corresponding image with the light beam, e.g. to projecting a number or a shape. The distance between the first lens 634 and the second lens 632 may be used for adjusting the focus sharpness of the projected image, depending on optical theory of lenses.

In some embodiments, a focus level of the projected image is adjusted by changing the relative distance between the first lens and the second lens.

In some embodiments, the rim wall has two connectors 605 for attaching two torsion springs 604 for fixing the downlight apparatus to a cavity 606 of a ceiling.

In some embodiments, the light holder has a holder wall.

An inner side of the holder wall has a screw groove.

The retractable tube has an protruding bar on an exterior surface.

For example, the light holder 20 has a screw groove 21 on an interior surface of its holder wall. The retractable tube 30 has a protruding bar 32.

The structure may be reversed in some other embodiments. For example, the retractable tube may be placed outside the holder wall of the light holder.

An offset distance between the light holder and the retractable tube is changed by moving the protruding bar of the retractable tube along the screw groove of the light holder.

Figure 7:
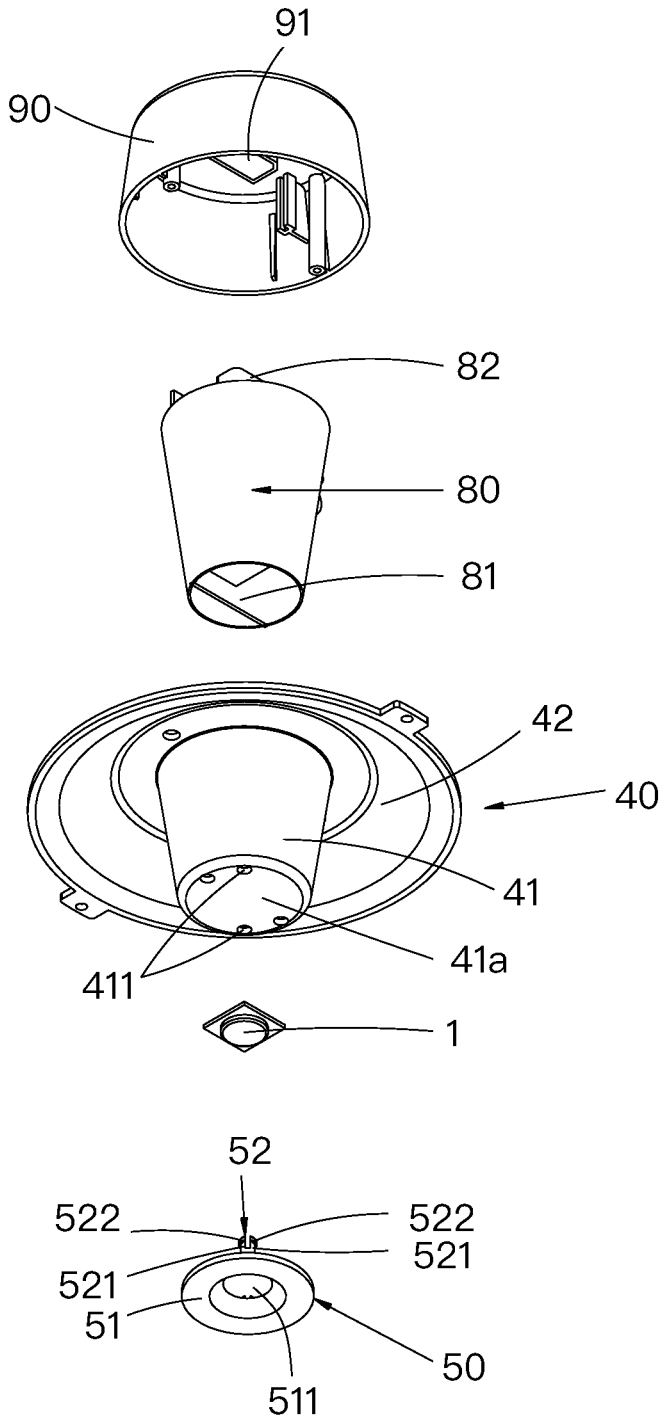
FIG. 7 illustrates another downlight apparatus embodiment.

In FIG. 7, the light source is a LED module 1 mounted on a central plate 41*a* of the light holder.

Figure 6:
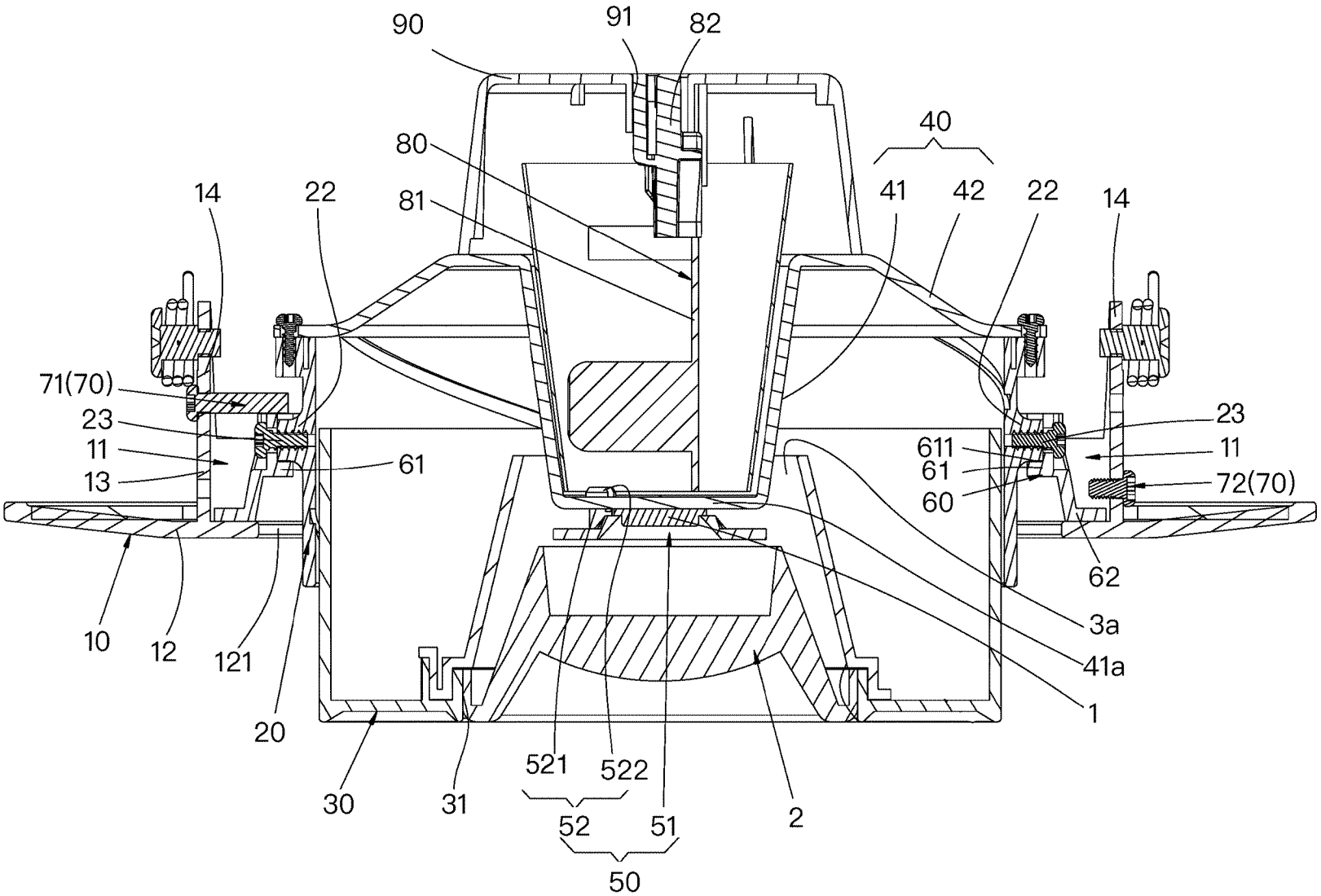
FIG. 6 illustrates a cross-sectional view of the example in FIG. 1.

In FIG. 6, a back side of the central plate has a socket 82 for routing electricity to the light source.

In FIG. 6, the downlight apparatus may also include a driver 80 for generating a driving current to the light source.

The light source has multiple types of LED modules.

The driver mixes lights of different optical parameters according to a rotation angle of the rotation ring with respect to the surface rim. In other words, the driver may control the light source to emit lights of different color temperatures. The driver detects the rotation angle of the rotation ring to determine a corresponding color temperature.

In FIG. 10, the downlight apparatus may also include a manual switch 641. The manual switch 641 may be placed on the surface rim or other places of the downlight apparatus.

The manual switch is operated to choose enabling or disabling adjustment of the optical parameter by rotating the rotation ring. For example, the manual switch may be a button or a sliding switch for users to select a position of 'enable' and 'disable' settings. When the manual switch is selected as "enable" mode, the rotation angle of the rotation ring is used for changing a color temperature, a light intensity or a color of the downlight apparatus. Otherwise, the rotation of the rotation ring does not affect the settings of the light source.

In some embodiments, the driver detects the distance between the optical cover and the light source to determines the driving current of the light source. For example, the driver detects a longer distance between the optical cover and light source, the driver increases or decreases the intensity of the light source based on predetermined settings.

In some embodiments, the rotation ring is rotated with respect to the surface rim with a grid unit for selecting a rotation angle of the rotation ring with respect to the surface rim from multiple discrete candidate values. That makes the adjustment not continuous but changed among discrete candidate values.

In some embodiments, the light holder has an central tube.

The light source has a LED module mounted on a top plate of the central tube.

A driver is placed inside the central tube. Such embodiment is explained in more details in following description on FIG. 5.

In some embodiments, the light holder has a back cover for concealing the driver in the central tube.

Figure 1:
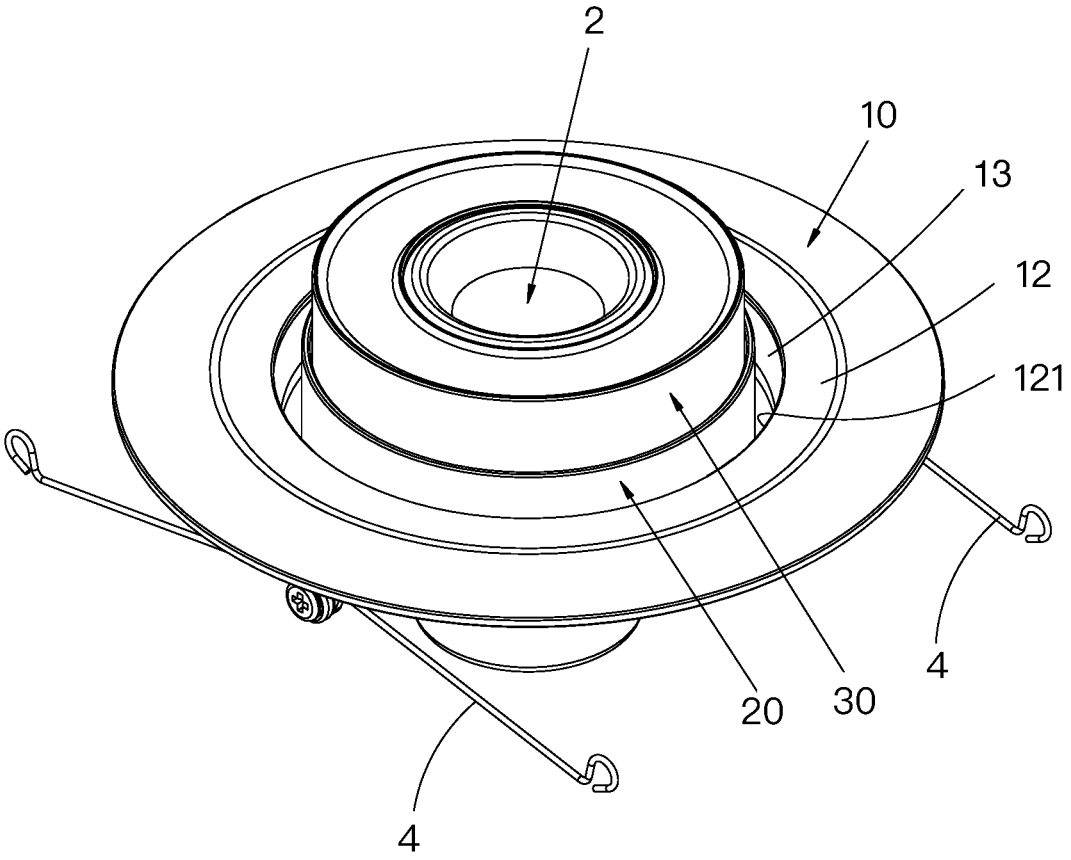
FIG. 1 illustrates a downlight apparatus embodiment.

Please refer to FIG. 1. In FIG. 1, a downlight apparatus has surface rim 10, a circular rim wall 13, a circular ring 12, an inner hole 121, a torsion spring 4, a retractable tube 30, a light holder 20 and a lens 2. This example has a similar structure for moving the light holder 20 with respect to the surface rim 10.

Figure 2:
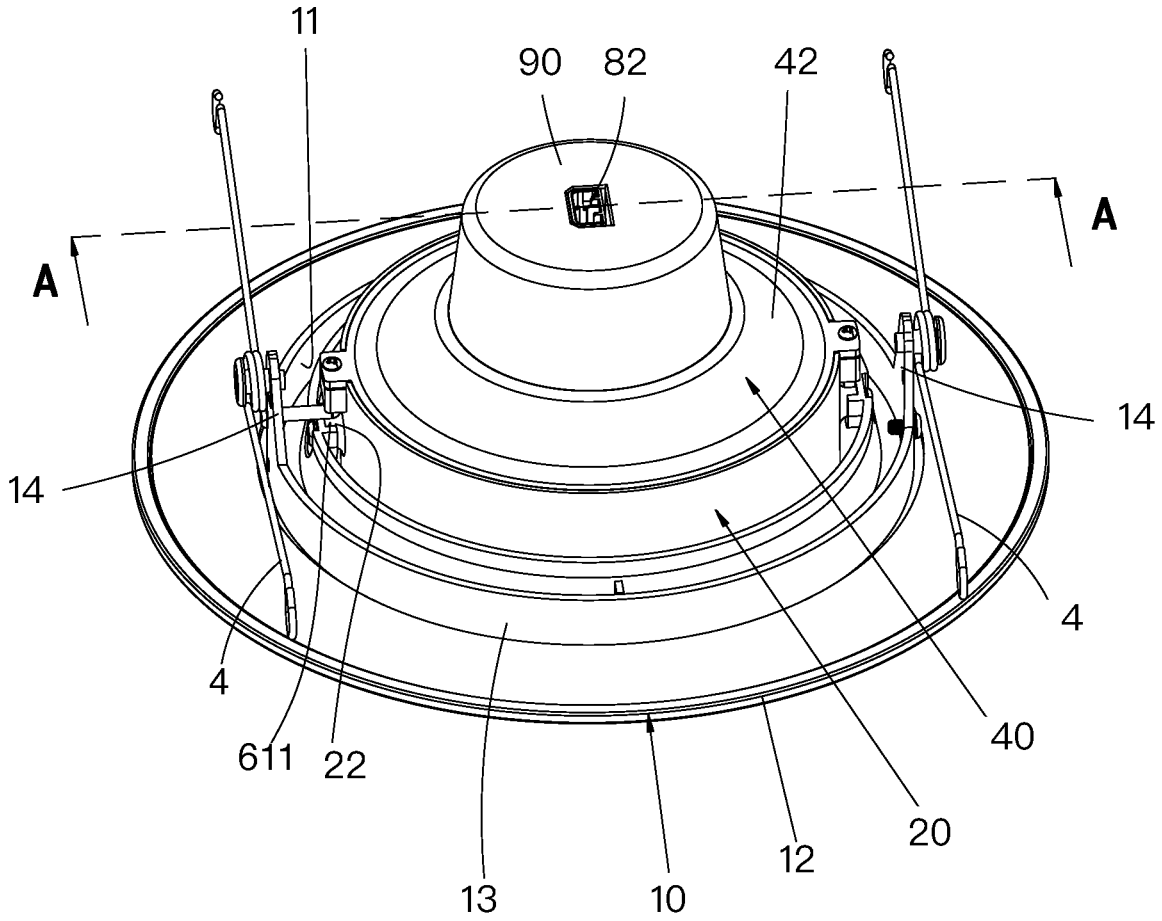
FIG. 2 illustrates a back view of the example in FIG. 1.

Please refer to FIG. 2, which shows a back view of the example in FIG. 1.

In FIG. 2, there is a socket 82 on a back cover 90 for inserting an external power source, e.g. a power wire. There are connecting arms 14 for connecting torsion springs 4 to be installed on a ceiling or a junction box.

The rim wall 13 provides a rotation space of the light holder 20. The circular ring 12 covers the installation hole of the cavity.

Figure 3:
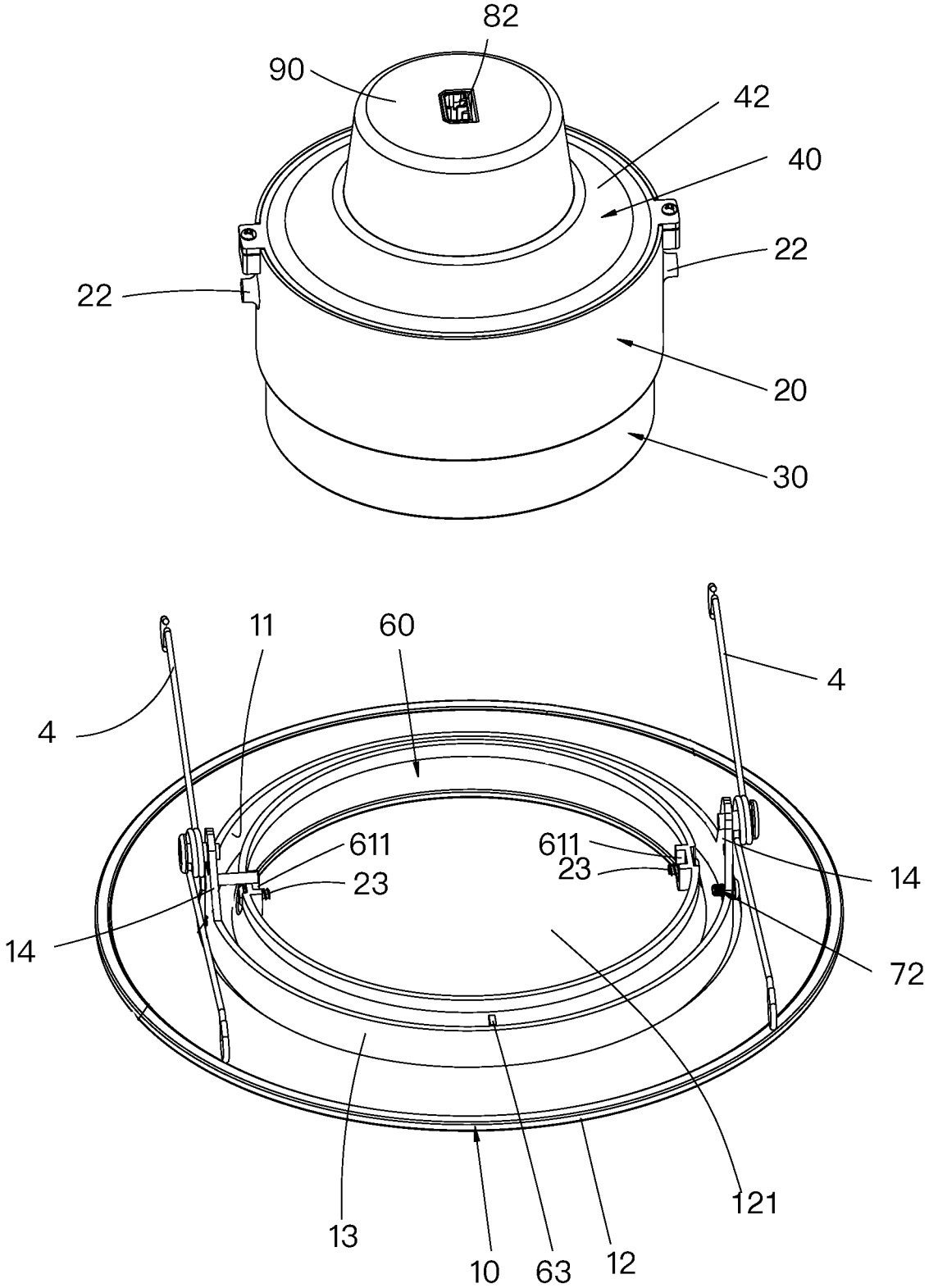
FIG. 3 illustrates an exploded view of the example in FIG. 1.

FIG. 3 shows a more details of the component in FIG. 2.

In addition to the components in FIG. 2 mentioned above, in FIG. 3, there is a connecting axle 22, a heat sink unit 40 that may be made of metal material, and a circular wall 42.

The rotation ring 60 is kept by the lever 11 to rotate with respect to the surface rim 10, as mentioned above.

The screws 72 are used for limiting the rotation ring to keep in the rotation space.

Figure 4:
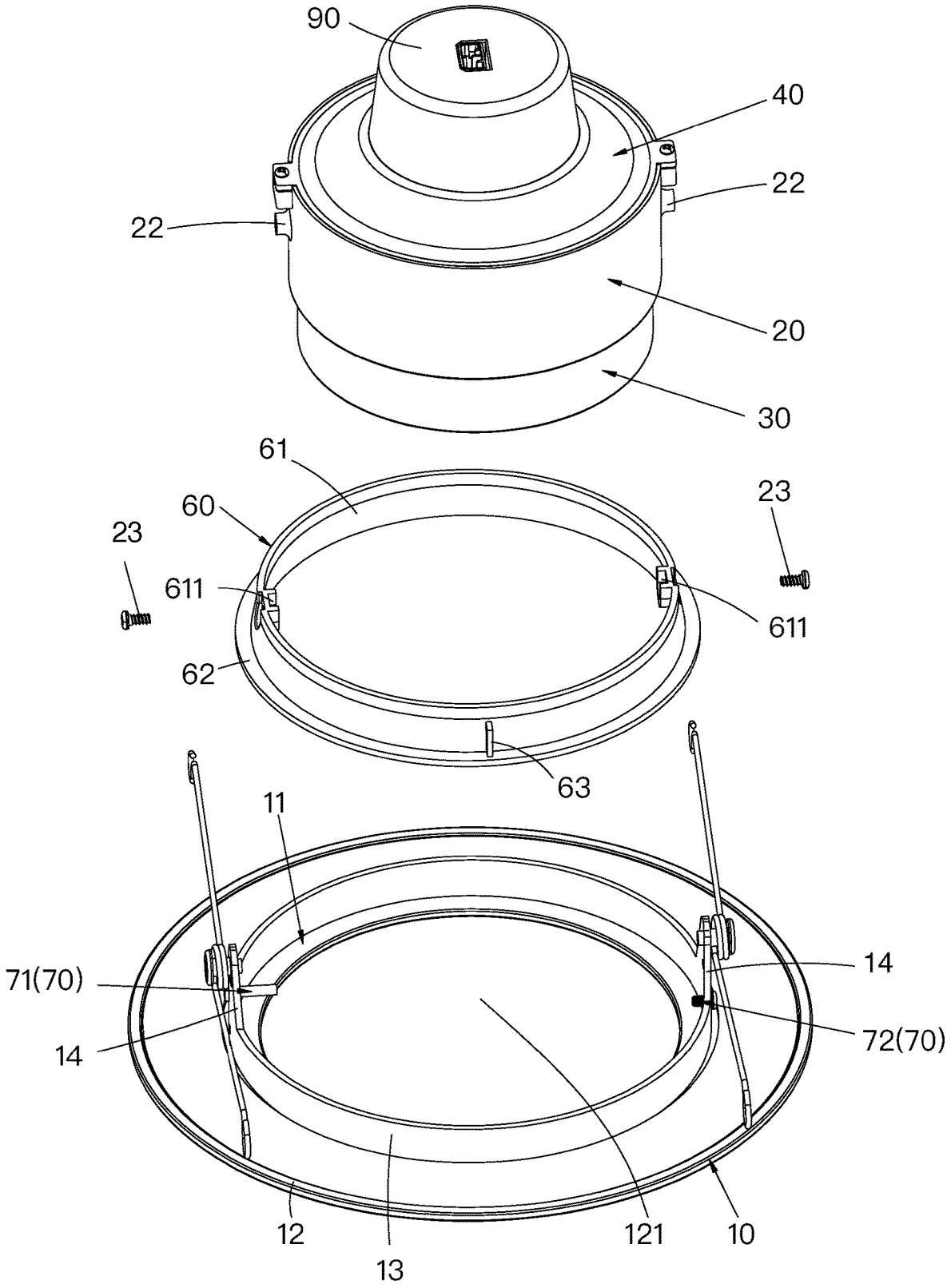
FIG. 4 illustrates another exploded view of the example in FIG. 1.

FIG. 4 further shows an exploded view to explain relation among the surface rim, the rotation ring 60, and the light holder 20. There are connecting holes 611 for inserting screws 23 for the light holder 20 to rotate with respect to the rotation ring 60 to change a tilt angle of the light holder 20 with respect to the surface rim 10.

Figure 5:
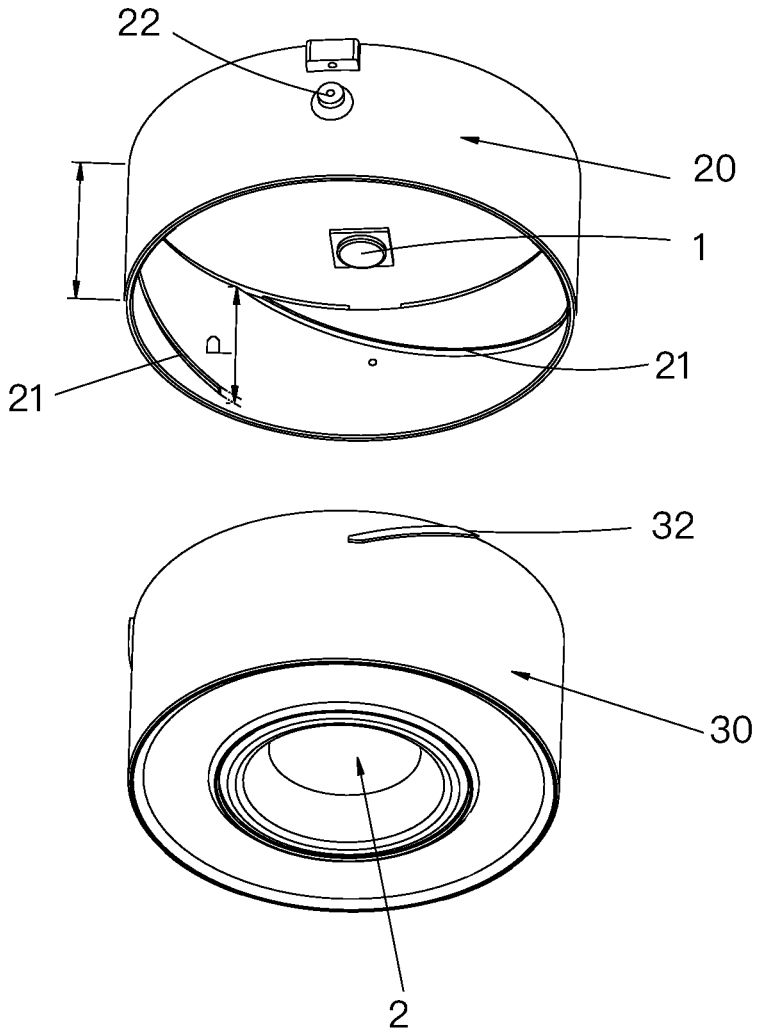
FIG. 5 illustrates a light holder example.

FIG. 5 further shows the screw groove 21 to be used for providing a rotation movement with the protruding bar 32 on the retractable tube 30 to change the distance between the light source 1 and the optical cover 2, which is a lens in this example.

FIG. 6 shows a cross-sectional view of a downlight apparatus, illustrating relation and structures of the components mentioned above.

FIG. 7 shows an exploded view of the example in FIG. 6.

In FIG. 6 and FIG. 7, the back cover 90 has an escape hole 91. There is a socket 82 for connecting to an external power source. A driver 80 has a driver control board 81.

The heat sink unit has a ring wall 50, a tubular housing 41 and a closing end 41*a* for mounting the light source 1. There are aligning holes 411 for connecting the components.

There is a buckle 52 with buckle arms 521 on a buckle head 522. There is a pressing plate 51 with an opening for forming a fixing unit.

Figure 8:
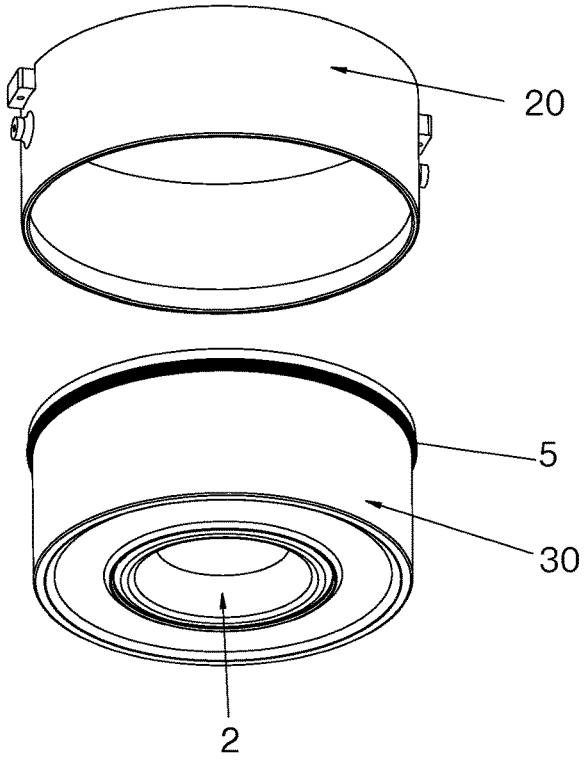
FIG. 8 illustrates another light holder example.

FIG. 8 shows another embodiment for changing the distance between the lens 2 and the light source with a rubber ring 5 to make the offset movement between the light holder 20 and the retractable tube 30 more smoothly while keeping the retractable tube 30 not moved if an external force is released.

Figure 9:
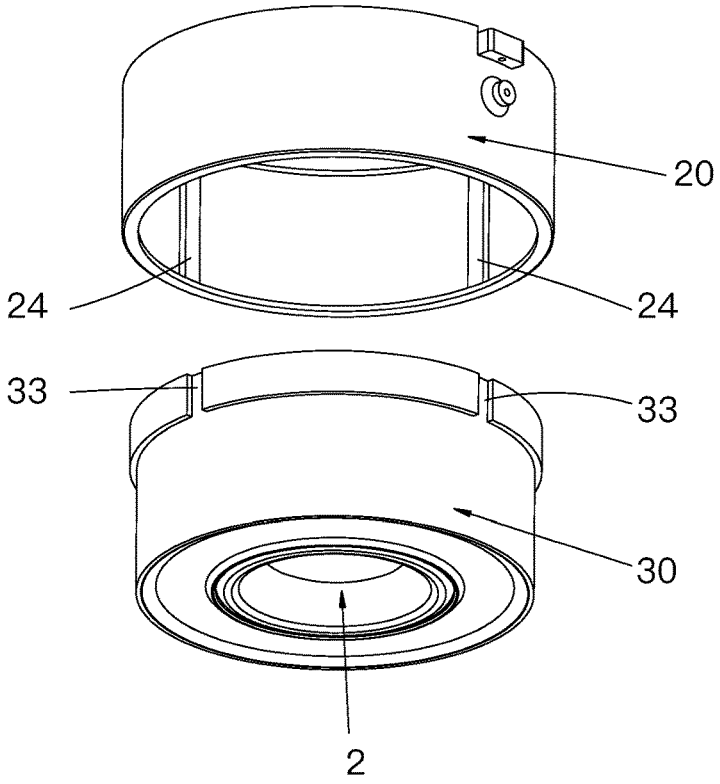
FIG. 9 illustrates another light holder example.

FIG. 9 shows another embodiment for changing the relative positions between the light holder 20 and the retractable tube 30. There is a groove 33 corresponding to a protruding bar 24 for providing a movement path of the retractable tube 30 to change the position of the lens 2.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A downlight apparatus, comprising:

a surface rim having a rim cover, and a rim wall protruding from the rim cover, the rim wall defining a light opening;

a rotation ring held by the rim wall to be rotatable along an axis of a center of the light opening;

a light source;

a light holder for holding the light source;

two rotation axles fixing the light holder to the rotation ring, wherein the light holder is rotatable to change a tilt angle of the light holder with respect to the rotation ring; and a retractable tube with an optical cover, wherein the retractable tube is manually movable to change a distance between the optical cover and the light source, wherein the rim wall provides a rotation track for holding the rotation ring to be rotated along the rotation track, wherein the rotation track is formed by a track ring, the rim wall and multiple levers, wherein the track ring is an extension ring protruding inwardly from the rim wall to the light opening, wherein the track ring and the multiple levers limit movement of the rotation ring on two opposite edges of the rotation ring, wherein the multiple levers are screws with a first portion kept in screw holes of the rim wall and a second portion protruding inwardly to the light opening to limit the movement of the rotation ring.

2. The downlight apparatus of claim 1, wherein the rim wall has two connectors for attaching two torsion springs for fixing the downlight apparatus to a cavity of a ceiling.

3. The downlight apparatus of claim 1, wherein the light holder has a holder wall, an inner side of the holder wall has a screw groove, the retractable tube has an protruding bar on an exterior surface, an offset distance between the light holder and the retractable tube is changed by moving the protruding bar of the retractable tube along the screw groove of the light holder.

4. The downlight apparatus of claim 1, wherein the rotation ring is rotated with respect to the surface rim with a grid unit for selecting a rotation angle of the rotation ring with respect to the surface rim from multiple discrete candidate values.

5. The downlight apparatus of claim 1, wherein the optical cover is a light passing cover, a light beam angle of the light is adjusted by changing a distance between the optical cover and the light holder.

6. The downlight apparatus of claim 5, wherein the light holder has a reflective cup for guiding a light of the light source to the optical cover.

7. The downlight apparatus of claim 1, wherein the light source is a LED module mounted on a central plate of the light holder.

8. The downlight apparatus of claim 7, wherein a back side of the central plate has a socket for routing electricity to the light source.

9. The downlight apparatus of claim 1, wherein the light holder has a central tube, the light source has a LED module mounted on a top plate of the central tube, a driver is placed inside the central tube.

10. The downlight apparatus of claim 9, wherein the light holder has a back cover for concealing the driver in the central tube.

11. The downlight apparatus of claim 1, further comprising a driver for generating a driving current to the light source, wherein the light source has multiple types of LED modules, the driver mixes lights of different optical parameters according to a rotation angle of the rotation ring with respect to the surface rim.

12. The downlight apparatus of claim 11, further comprising a manual switch, wherein the manual switch is operated to choose enabling or disabling adjustment of the optical parameter by rotating the rotation ring.

13. The downlight apparatus of claim 11, wherein the driver detects the distance between the optical cover and the light source to determines the driving current of the light source.

14. The downlight apparatus of claim 1, wherein the optical cover comprises a first lens for condensing a light of the light source to form a light beam.

15. The downlight apparatus of claim 14, wherein the light source has a second lens, the light beam is determined by the first lens, the second lens and a relative distance between the first lens and the second lens.

16. The downlight apparatus of claim 15, further comprising an image mask for projecting a corresponding image with the light beam.

17. The downlight apparatus of claim 16, wherein a focus level of the projected image is adjusted by changing the relative distance between the first lens and the second lens.

* * * * *